US010646080B2

(12) United States Patent
Regan

(10) Patent No.: US 10,646,080 B2
(45) Date of Patent: May 12, 2020

(54) COMBINATION TOILET SEAT

(71) Applicant: John E. Regan, Walnut Creek, CA (US)

(72) Inventor: John E. Regan, Walnut Creek, CA (US)

(73) Assignee: John E. Regan, Walnut Creek, CA (US)

( * ) Notice: Subject to any disclaimer, the term of this patent is extended or adjusted under 35 U.S.C. 154(b) by 41 days.

(21) Appl. No.: 15/609,885

(22) Filed: May 31, 2017

(65) Prior Publication Data

US 2018/0344106 A1 Dec. 6, 2018

(51) Int. Cl.

| | |
|---|---|
| ***A47K 13/06*** | (2006.01) |
| ***A47K 13/12*** | (2006.01) |
| ***A47K 13/24*** | (2006.01) |
| ***A47K 13/04*** | (2006.01) |
| ***A47K 13/26*** | (2006.01) |
| *A47K 13/02* | (2006.01) |

(52) U.S. Cl.

CPC ..... *A47K 13/06* (2013.01); *A47K 13/04* (2013.01); *A47K 13/12* (2013.01); *A47K 13/24* (2013.01); *A47K 13/26* (2013.01); *A47K 13/02* (2013.01)

(58) Field of Classification Search

CPC ..... A47K 13/06

USPC ..... 4/239, 235, 234, 240

See application file for complete search history.

(56) References Cited

U.S. PATENT DOCUMENTS

| | | | | |
|---|---|---|---|---|
| 2,814,048 A * | 11/1957 | Reinhard | A47K 13/12 4/240 |
| 3,210,777 A * | 10/1965 | Hideo | A47K 13/00 4/235 |
| 6,189,159 B1 * | 2/2001 | Bailey | A47K 13/06 4/235 |
| 6,952,842 B2 * | 10/2005 | Courtney | A47K 13/06 4/235 |

* cited by examiner

*Primary Examiner* — Lauren A Crane
(74) *Attorney, Agent, or Firm* — Quinn IP Law

(57) ABSTRACT

A toilet seat assembly for installation on a toilet includes a first toilet seat having a first seat aperture and a second toilet seat having a second seat aperture which is smaller than the first seat aperture. At least one of the first and second seats includes an attaching member for selectively attaching the first and second seats to each other. The first and second seat are hingedly connected to each other. When the first and second seats are attached by the attaching member, the first and second seats can be articulated together by an articulating force exerted on either one of the first and second seats. In one example, the first and second seats each include an attaching member which is a magnetic element such that the first and second seats are selectively attached to each other by a magnetic force generated between the magnetic elements.

17 Claims, 5 Drawing Sheets

COMBINATION TOILET SEAT

TECHNICAL FIELD

The present disclosure pertains to a toilet seat assembly, and in particular, to a toilet seat assembly including a first seat and a second seat.

BACKGROUND

Small children, especially during toilet training, benefit from using a toilet seat with an aperture which is smaller than the aperture of a standard toilet seat. The smaller seat aperture keeps the child from falling in the toilet bowl and the child does not have to grip sides of toilet seat in support therefore providing a more sanitary experience. Public restrooms, including public restrooms designated for family use, provide grab bars and elevated toilets for the disabled and elderly, and changing tables for diapering infants, however, do not provide toilet seats with smaller apertures for use by small children. A parent or caregiver can bring a portable insert into the public restroom for use with a standard toilet seat, however, this requires the parent or caregiver to obtain a portable insert, transport the portable insert with them, which may be inconvenient and/or impracticable in some circumstances, and take additional time to install the insert on the seat before it is available for use by the small child. Further, the size and shape of seat apertures of public toilets may vary. A portable insert may not properly fit the seat aperture of every public toilet seat, such that the portable insert may shift or be unstable on the public toilet seat, introducing a safety hazard or pinching risk to the small child. Cleaning of the insert contaminated by contact with the public seat and/or soiled during use is an additional inconvenience to the parent or caregiver.

Residential combination toilet seats are available for use in the bathrooms of private homes, but are not practical for installation in public restrooms having tankless toilets with flushing mechanisms typically positioned centrally above the toilet. Residential combination toilet seats typically include a toilet seat lid and a smaller toilet seat which is removable from the standard toilet seat and/or can be stowed away in the lid of the toilet seat. With the lid raised, the flushing mechanism of a standard residential toilet is accessible, generally being positioned on the side or top of the toilet tank. The toilet seat lid, if present on a commercial tankless toilet, would block access to the flushing mechanism, requiring the toilet lid to be closed after use to have access to the flushing mechanism to flush the toilet. This would require a user to touch additional toilet surfaces while manipulating the lid, the smaller seat, and the larger seat, which may be unsanitary for the user. For commercial toilets having flushing mechanisms which are automated and include sensors, the toilet lid would interfere with the sensing mechanism, thus interfering with and/or preventing the automated operation of the flushing mechanism.

SUMMARY

A toilet seat assembly including a first seat and a second seat is provided herein. The toilet seat assembly described herein may also be referred to as a combination toilet seat, including a first seat having a first aperture and a second seat having second aperture, where the second aperture is smaller than the first aperture such that the second seat is suitable for use by a small child. The smaller aperture is sized such that a small child can be seated on the second seat without falling into the toilet bowl and/or without requiring the small child to hold on to the toilet seat to support themselves during use of the toilet. The combination toilet seat provided herein is configured such that the first seat and second seat are selectively attached to each other by an attaching mechanism including at least one attaching member. When attached to each other by the attaching mechanism, the first and second seats can be articulated relative to the toilet as a single unit, and remain attached to each other in the articulated position, thus minimizing contact with the seat assembly during movement of the seats from one position to another during use. Further, the attaching members prevent lateral shifting of the child's smaller seat relative to the larger seat, thus reducing the likelihood of a user of pinching or entrapping a finger, skin, or clothing between the first and second seats. The toilet seat assembly described herein can be configured with the first and second seats each having a split front, e.g., have an anterior opening to allow a child or caregiver access for cleaning the child after use without making contact with the seat surfaces, and reducing the surface area of the toilet seat which may be soiled during use. In an illustrative example, the toilet seat assembly is suitable for use as a commercial toilet seat for installation in a commercial, public and/or non-residential restroom, being distinguished from a residential toilet seat by the absence of a toilet lid or covering member. Because the toilet seat assembly described herein does not include a toilet lid, the flushing mechanism is accessible, relative to the toilet seat assembly, in the same manner as a conventional commercial toilet seat.

In one example, a combination toilet seat assembly is provided which includes a first toilet seat having a first seat aperture and a second toilet seat having a second seat aperture, where the first and second seat are hingedly connected to each other by a hinge assembly such that each of the first and the second seats can be independently articulated relative to the hinge assembly. In one example, the second seat aperture is smaller than the first seat aperture, such that the second seat aperture is sized such that a small child seated on the second seat is supported so as to not fall through the aperture. The seat assembly includes an attaching mechanism comprising at least one attaching member. When the first and second seats are attached by the attaching mechanism, the first and second seats can be articulated together by an articulating force exerted on either one of the first and second seats. In one example, one of the first and second seats includes a first attaching member configured such that the first and second seats are selectively attached to each other by attachment of the first attaching member to the other of the first and second seat. In another example, each of the first and second seat includes an attaching member, and each of the attaching members includes a magnetic element such that the first and second seats are selectively attached to each other by a magnetic force generated between the first magnetic element and the second magnetic member. In one example, the attaching member is contained within the body of the seat. In another example, the attaching member protrudes from the second seat and/or is contained in a support member attached to the base surface of the second seat. In one example, the attaching mechanism includes a suction element for attaching the second seat to a seating surface of the first seat.

The above noted and other features and advantages of the present disclosure are readily apparent from the following detailed description when taken in connection with the accompanying drawings.

DETAILED DESCRIPTION

A toilet seat assembly including a first seat and a second seat is provided herein. In an illustrative example, the toilet seat assembly is suitable for use as a commercial toilet seat for installation in a commercial, public and/or non-residential restroom, distinguished from a residential toilet seat by the absence of a toilet lid or covering member. The term "commercial, public and/or non-residential restroom" is intended to include restrooms and toilets such as those found in public and/or semi-public facilities, such as public or municipal buildings, stores, restaurants, offices, schools, hospitals, recreational facilities, etc. The toilet seat assembly described herein may also be referred to as a combination toilet seat, including a first seat having a first aperture and a second seat having second aperture, where the second aperture is smaller than the first aperture such that the second seat is suitable for use by a small child. The smaller aperture is sized such that a small child can be seated on the second seat without falling into the toilet bowl and/or without requiring the small child to hold on to the toilet seat to support themselves during use of the toilet. The combination toilet seat provided herein is configured such that the first seat and second seat are selectively attached to each other by an attaching mechanism including at least one attaching member. When attached to each other by the attaching mechanism, the first and second seats can be articulated relative to the toilet as a single unit, and remain attached to each other in the articulated position, thus minimizing contact with the seat assembly during movement of the seats from one position to another during use. Further, the attaching members prevent lateral shifting of the child's smaller seat relative to the larger seat, thus reducing the likelihood of a user of pinching or entrapping a finger, skin, or clothing between the first and second seats. The toilet seat assembly described herein can be configured with the first and second seats each having a split front, e.g., have an anterior opening to allow a child or caregiver access for cleaning the child after use without making contact with the seat surfaces, and reducing the surface area of the toilet seat which may be soiled during use. In an illustrative example, the toilet seat assembly is suitable for use as a commercial toilet seat for installation in a commercial, public and/or non-residential restroom, being distinguished from a residential toilet seat by the absence of a toilet lid or covering member. Because the toilet seat assembly described herein does not include a toilet lid, the flushing mechanism is accessible, relative to the toilet seat assembly, in the same manner as a conventional commercial toilet seat.

Figure 2:
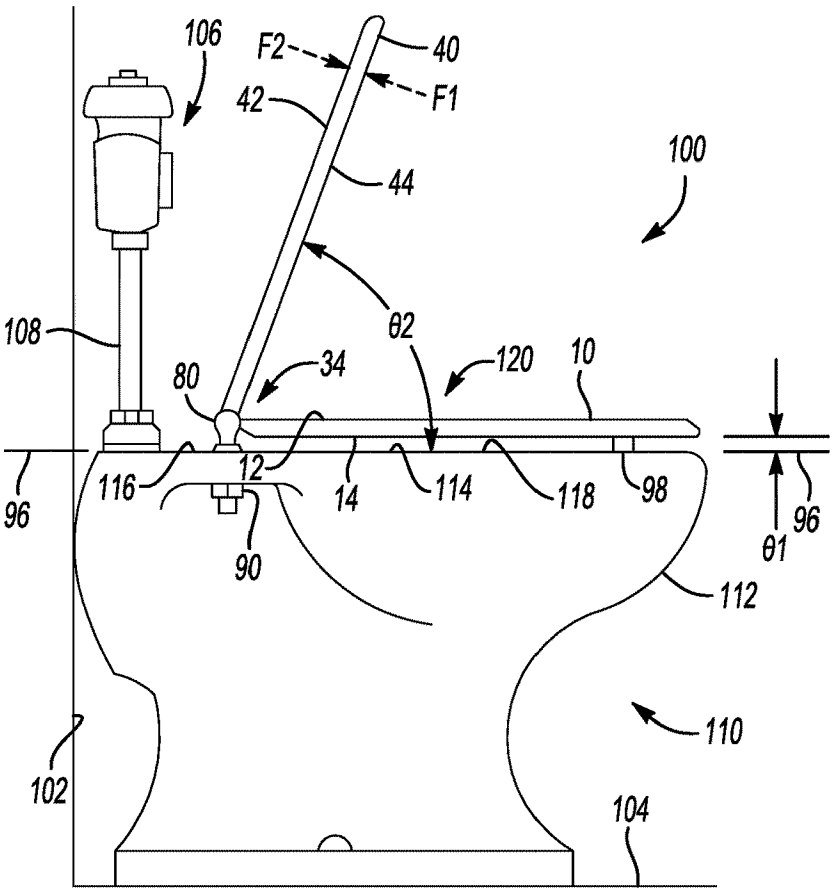
FIG. 2 is a schematic side view of the toilet seat assembly of FIG. 1, showing the first seat in a lowered position and the second seat in a raised position.
Figure 1:
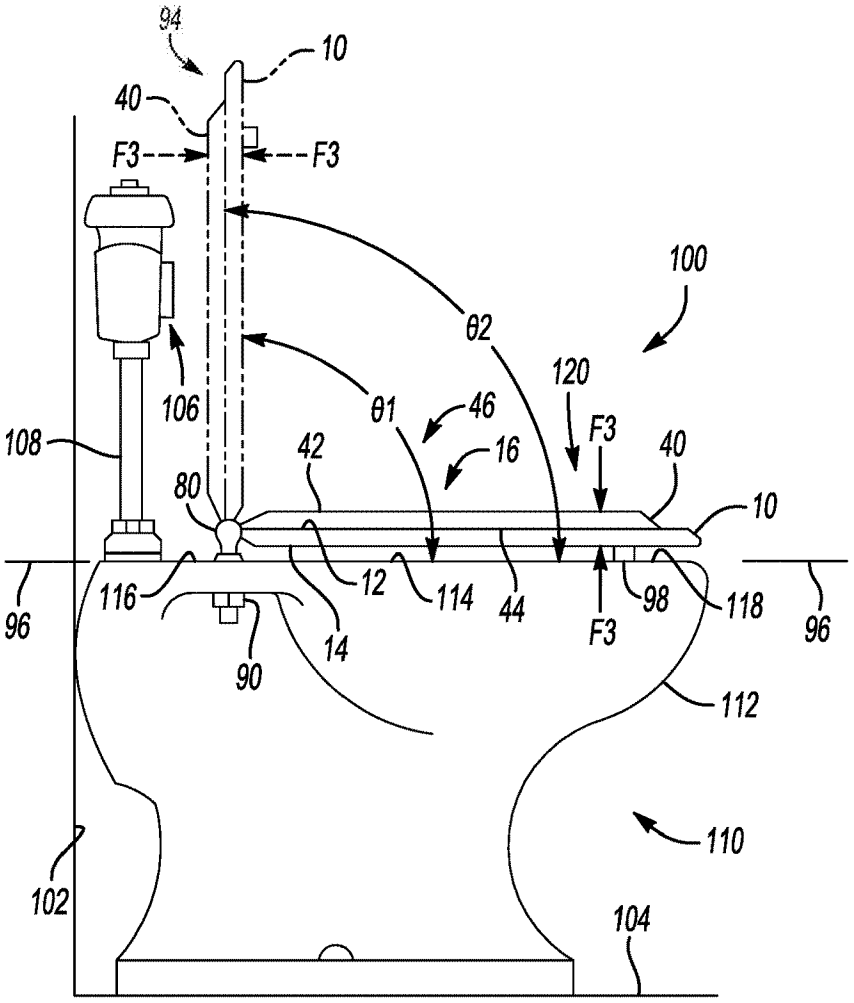
FIG. 1 is a schematic side view of a toilet seat assembly installed to a toilet, the toilet seat assembly including a first seat and a second seat.

Referring to the drawings wherein like reference numbers represent like components throughout the several figures, the elements shown in FIGS. 1-12 are not necessarily to scale or proportion. Accordingly, the particular dimensions and applications provided in the drawings presented herein are not to be considered limiting. Referring to FIGS. 1 and 2, a toilet seat assembly 100, which may also be referred to herein as a toilet seat combination and/or as a seat assembly, is shown installed to a toilet 110. In the example shown, the toilet 110 is a tankless toilet of the type commonly installed in a non-residential or commercial restroom, and includes a toilet bowl 112 having an upper surface 114 configured to receive the seat assembly 100. The upper surface 114 includes a rim portion 118 and a mounting portion 116. The toilet bowl 112 includes an opening or aperture 120 which is defined by the rim portion 118. The aperture 120 and rim portion 118 are shaped to correspond to the shape of the first toilet seat 10, which in the example shown in FIGS. 3-6 is oval shaped. The example shown in FIGS. 3-6 is illustrative, and it would be understood that the shape of the rim portion 118 of the toilet 110 and the corresponding toilet seats 10 and 40 could be round, oval, elongated oval, square, rectangular, elongated, or trapezoidal in shape. The first and second seats 10, 40 are hingedly connected to each other by a hinge assembly 80. The seat assembly 100 is connected and installed to the toilet 110 by connecting the hinge assembly 80 to the mounting portion 116 by one or more hinge fasteners 90. The hinge assembly 80 is configured such that the hinge assembly 80 can be installed to a standard commercial toilet 110. For example, the hinge assembly 80 can be configured to mount to openings in the mounting portion 116 which are spaced at a standard distance from each other, which in one example is a spacing of 5.5" for commercial toilets. In one example, the hinge assembly 80 can include a check hinge and/or hinge stops to prevent articulation of the each of the first and second seats 10, 40 more than a few degrees beyond vertical, e.g., to stop over-articulation of each of the first and second seats 10, 40 past an upright position and toward the flushing mechanism 106. In the example shown in FIGS. 1 and 2, the toilet 110 is shown positioned on a floor 104 adjacent a wall 102, and including a flushing mechanism 106 connected to a supply pipe 108. The supply pipe 108 can be connected to a water source (not shown) via the wall 102, and the floor 104 can include a drainage outlet (not shown) to receive water and waste flushed from the toilet bowl 112 by water received via the supply pipe 108 during a flushing event. As used herein, the terms upper, lower, front and back (or rear) refer to the orientation of the toilet 110 and the seat assembly 100 in the installed position shown in FIGS. 1 and 2 and relative to the toilet 110, where the upper portion of the toilet 110 includes the upper toilet surface 118, the lower portion of the toilet 110 is directly in contact with the floor 104, the rear or back portion of the toilet 110 is immediately adjacent the wall 102 and the mounting portion 116, and opposite the front portion of the toilet 110. The toilet 110 and toilet seat assembly 100 is characterized by a central axis 86 (see FIGS. 3-4), which can also be referred to herein as a longitudinal axis of the toilet 110 and toilet seat assembly 100. The toilet 110 and toilet seat assembly 100 is further characterized by a lateral axis 88 (see FIGS. 3-4) which is perpendicular to the longitudinal axis 86. The longitudinal and lateral axes 86, 88 are parallel to a reference plane 96 which is a horizontal plane defined by the upper surface 114 of the toilet 110 and/or parallel to the floor 104.

Figure 4:
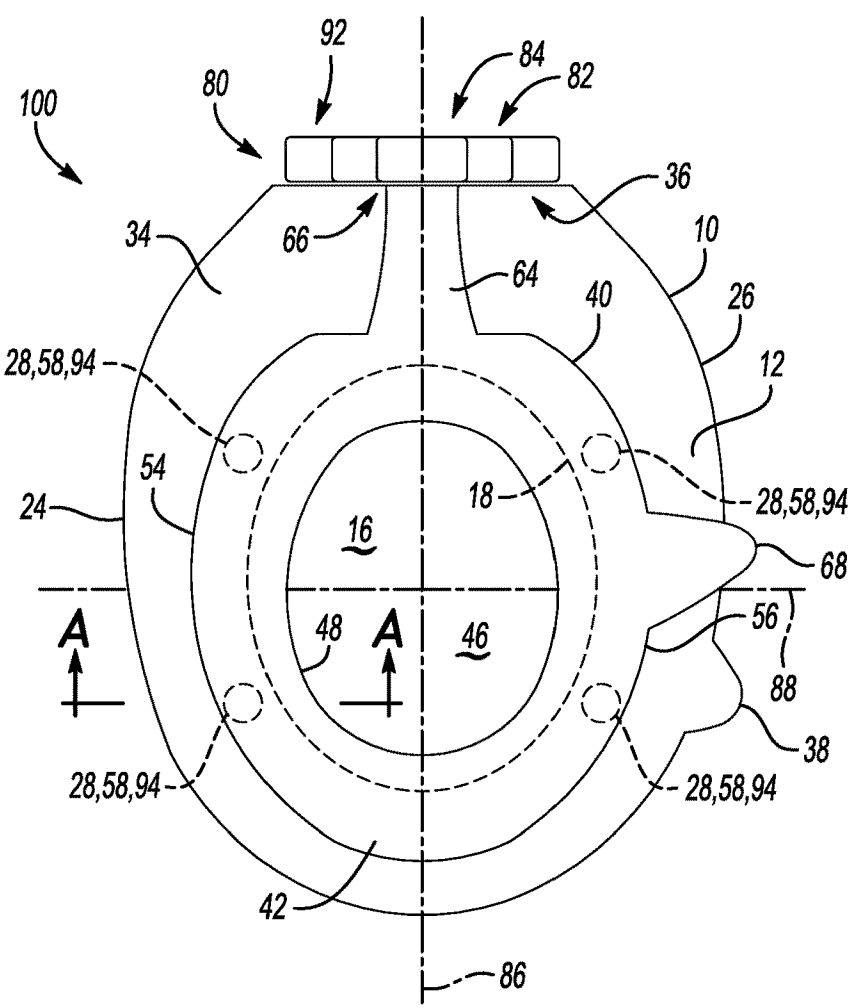
FIG. 4 is a schematic top view of a second example of the toilet seat assembly of FIG. 1 with the first and second seat attached by at least one attaching element.
Figure 5:
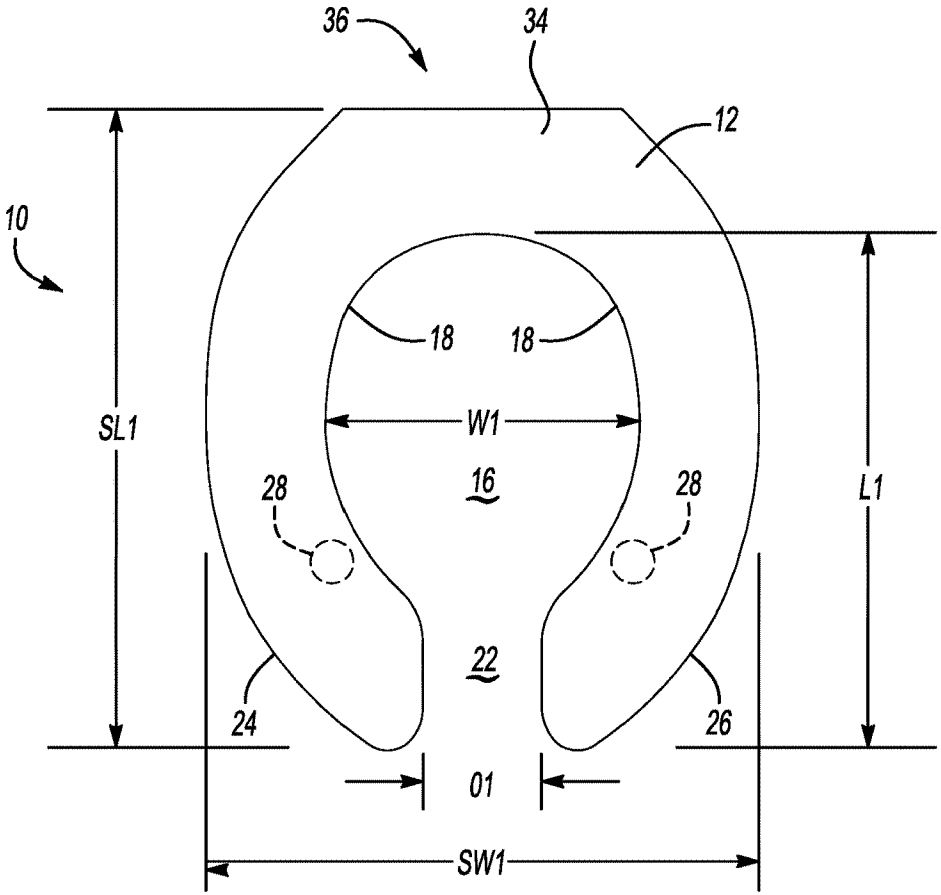
FIG. 5 is a schematic top view of the first seat of the toilet seat assembly of FIG. 3.

Referring to FIGS. 1-4, the first seat 10, which may also be referred to herein as the larger seat, lower seat or bottom seat, includes an upper seating surface 12 and a lower base surface 14. The seating surface 12 and base surface 14 encapsulate a core 20 (see FIG. 7) of the first seat 10. The first seat 10 includes a central aperture 16 (see FIGS. 3-5) which is defined by a periphery 18. In a first example shown in FIG. 3, the first seat 10 includes a front opening 22, which may also be referred to herein as an anterior opening 22, which forms a gap separating first and second side portions 24, 26 of the first seat 10, as is commonly seen for commercial toilet seats. As shown in FIG. 5, the first seat 10 is characterized by a seat length SL1 and a seat width SW1. The aperture 16 of the first seat 10 is characterized by an aperture width W1 and an aperture length L1. The first and second side portions 24, 26 are separated by an anterior opening 22 having an opening width θ.

The first and second side portions 24, 26 are joined at the rear of the first seat 10 by a posterior portion 34 of the seat. The posterior portion 34 includes a hinge interface 36 for connecting the hinge assembly 80 to the first seat. In the example shown, the hinge assembly 80 includes one or more first hinge elements 82 for connecting the hinge assembly 80 to the first seat 10. In one example shown in FIG. 4, the first seat 10 includes a handle 38 which protrudes from the first seat 10 such that the handle 38 can be contacted by a user to exert a force F1, F2 on the first seat 10 to articulate the first seat 10 relative to the hinge assembly 80, without having to touch or otherwise make contact with the first and second side portions 24, 26 or seating surface 12 of the first seat 10. The force exerted by the user to move the seat between lowered and raised positions, which may be also be referred to herein as an articulating force, can be exerted on the handle 38 or directly on another portion of the first seat 10 as an upward force F1 (see FIG. 2) to articulate the first seat 10 from a lowered position (shown in solid lines in FIG. 1) toward a raised position (shown in phantom lines in FIG. 1), through an increasing angle of articulation θ1, where the articulation angle is defined between a first plane defined by the base surface 14 of the first seat 10 and a reference plane 96, where, with the toilet seat 100 installed to the toilet 110, the reference plane 96 is defined as a plane horizontal to the upper surface 114 of the toilet 110 and/or generally parallel to the floor 104. In the example shown in FIG. 1, the articulation angle θ1 of the first seat 10 in the lowered position is zero degrees, where the first seat 10 is resting on and/or supported by the rim portion 118 such that the base surface 14 of the first seat 10 is generally parallel to the reference plane 96. In an illustrative example shown in FIGS. 1 and 2, the first seat 10 can include one or more support members 98 extending from the base surface 14 of the first seat 10, such that when the first seat 10 is in the lowered position, the support members 98 contact the upper toilet surface 114 of the rim portion 118 to maintain a gap between the base surface 14 and the upper toilet surface 114, minimizing the contact and transfer of contamination between the base surface 14 of the first seat 10 and the rim portion 118 of the toilet 110. The gap between first seat 10 and the rim portion 118 established by the support member 98 can also serve to prevent and/or minimize pinching or entrapment of fingers, skin, clothing, etc. between the first seat 10 and the rim portion 118 by a user of the seat assembly 100.

As shown in FIG. 1, the base surface 14 of the first seat 10 in the raised (phantom) position is upright and generally perpendicular to the reference plane 96 such that in this position the articulation angle θ1 is approximately 90 degrees, that is, in the upright or raised position the first seat 10 has an articulation angle θ1 that is in the range of 70 degrees to 110 degrees such that the first seat 10 is moved sufficiently away from the upper surface 114 of the toilet 110 to provide clear access to the toilet bowl 112 by a user. The articulating force exerted by the user on the first seat 10 can be a downward force F2 (see FIG. 2) to articulate the first seat 10 from a raised position (shown in phantom lines in FIG. 1) to a lowered position (shown in solid lines in FIG. 1) or in a direction where the articulation angle θ1 of the first seat 10 is decreasing. The hinge assembly 80 can include a self-sustaining and/or positioning element 92 (see FIGS. 3-4) for retaining the first seat 10 in a selected articulated position, e.g., in a position where the articulation angle θ1 is greater than zero. By way of example, the positioning element 92 can be configured as one or more of a positioning hinge and a prevailing torque hinge which can also be referred to as a constant torque or friction hinge, for retaining the first seat 10 in a selected articulated position. The hinge 80 and/or positioning element 92 can also include one or more check hinge elements, hinge posts, and/or hinge stops to prevent over-articulation of each of the seats 10, 40 from the upright position (90 degree position) toward the flushing mechanism. In one example, the hinge 80 is configured to prevent articulation of the first seat beyond an articulation angle θ1 of 115 degrees, or more preferable, beyond an articulation angle θ1 of 111 degrees, and to prevent articulation of the second seat beyond an articulation angle θ2 of 115 degrees, or more preferable, beyond an articulation angle θ2 of 111 degrees.

Figure 6:
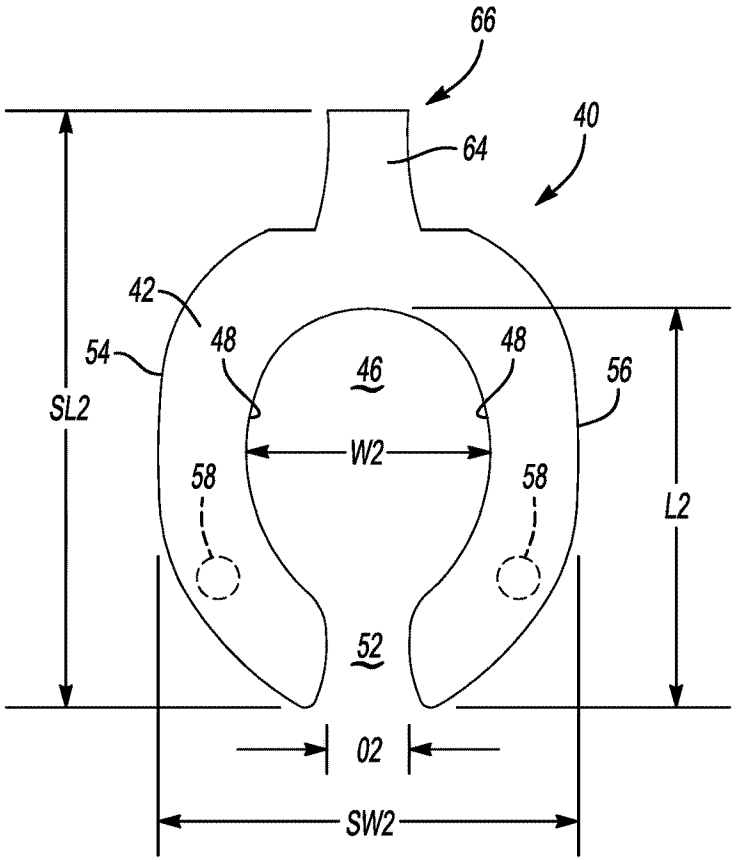
FIG. 6 is a schematic top view of the second seat of the toilet seat assembly of FIG. 3.

Referring to FIGS. 1-4, the second seat 40, which may also be referred to herein as the smaller seat, upper seat or top seat, includes an upper seating surface 42 and a lower base surface 44. The seating surface 42 and base surface 44 encapsulate a core 50 (see FIG. 7) of the second seat 40. The second seat 40 includes a central aperture 46 (see FIGS. 3, 4 and 6) which is defined by a periphery 48. In a first example shown in FIG. 3, the second seat 40 includes a front opening 52, which may also be referred to herein as an anterior opening 52, which forms a gap separating first and second side portions 54, 56 of the second seat 40. As shown in FIG. 6, the second seat 40 is characterized by a seat length SL2 and a seat width SW2. The aperture 46 of the second seat 40 is characterized by an aperture width W2 and an aperture length L2. The first and second side portions 54, 56 are separated by an anterior opening 52 having an opening width O2.

The first and second side portions 54, 56 are joined at the rear of the second seat 40 by a posterior portion 64 of the seat. The posterior portion 64 includes a hinge interface 66 for connecting the hinge assembly 80 to the first seat. In the example shown, the hinge assembly 80 includes one or more second hinge elements 84 for connecting the hinge assembly 80 to the second seat 40. In one example shown in FIG. 4, the second seat 40 includes a handle 68 which protrudes from the second seat 40 such that the handle 68 can be contacted by a user to exert a force F1, F2 on the second seat 40 to articulate the second seat 40 relative to the hinge assembly 80, without having to touch or otherwise make contact with the first and second side portions 54, 56 or seating surface 42 of the second seat 40. The force exerted by the user to move the seat between lowered and raised positions, which may also be referred to herein as an articulating force, can be exerted on the handle 68 or directly on another portion of the second seat 40 as an upward force F1 (see FIG. 2) to articulate the second seat 40 from a lowered position (shown in solid lines in FIG. 1) toward a raised position (shown in phantom lines in FIG. 1), through an increasing angle of articulation θ2, where the articulation angle is defined by the intersection of a first plane defined by the base surface 44 of the second seat 40 and a reference plane 96, where, with the toilet seat 100 installed to the toilet 110, the reference plane 96 is defined as a plane horizontal to the upper surface 114 of the toilet 110 and/or generally parallel to the floor 104. In the example shown in FIG. 1, the articulation angle θ2 of the second seat 40 in the lowered position is zero degrees, where the second seat 40 is resting on and/or supported by the seating surface 12 of the first seat 10 such that the base surface 44 of the second seat 40 is generally parallel to the reference plane 96. In an illustrative example shown in FIGS. 9 and 10, the second seat 40 can include one or more support members 70 extending from the base surface 44 of the second seat 40, such that when the second seat 40 is in the lowered position, the support members 70 contact the seating surface 12 of the first seat 10 to maintain a gap between the base surface 44 of the second seat 40 and the seating surface 12 of the first seat 10, minimizing the contact and transfer of contamination between the base surface 44 and the seating surface 12. The gap between first and second seats 10, 40 established by the support member 70 can also serve to prevent and/or minimize pinching or entrapment of fingers, skin, clothing, etc. between the first and second seats 10, 40 by a user of the seat assembly 100.

As shown in FIG. 1, the base surface 44 of the second seat 40 in the raised (phantom) position is upright and generally perpendicular to the reference plane 96 such that in this position the articulation angle θ2 is approximately 90 degrees, that is, in the upright or raised position the second seat 40 has an articulation angle θ2 that is in the range of 70 degrees to 110 degrees such that the second seat 40 is moved sufficiently away from the seating surface 12 of the first seat 10 to provide clear access to the first seat 10 by a user. The articulating force exerted by the user on the second seat 40 can be a downward force F2 (see FIG. 2) to articulate the second seat 40 from a raised position (shown in phantom lines in FIG. 1) to a lowered position (shown in solid lines in FIG. 1) or in a direction where the articulation angle θ2 of the second seat 40 is decreasing. The hinge assembly 80 can include a positioning element 92 (see FIGS. 3-4) for retaining the second seat 40 in an articulated position, e.g., in a position where the articulation angle θ2 is greater than zero. By way of example, the positioning element 92 can be configured as one or more of a positioning hinge and a prevailing torque hinge which can also be referred to as a constant torque or friction hinge, for retaining the first seat 10 in a selected articulated position. The hinge assembly 80 and/or positioning element 92 can also include one or more check hinge elements, hinge posts, and/or hinge stops to prevent over-articulation of each of the seats 10, 40 from the upright position (90 degree position) toward the flushing mechanism. In one example, the hinge assembly 80 is configured to prevent articulation of the first seat beyond an articulation angle θ1 of 115 degrees, or more preferable, beyond an articulation angle θ1 of 111 degrees, and to prevent articulation of the second seat beyond an articulation angle θ2 of 115 degrees, or more preferable, beyond an articulation angle θ2 of 111 degrees. The hinge assembly 80 is configured such that the second seat 40 is not detachable from the first seat 10, and such that the first and second seats 10, 40 are aligned to have a common longitudinal axis 86. The hinge assembly 80 including the first and second hinge elements 82, 84 are configured to constrict lateral movement of the second seat 40 relative to the first seat 10 and relative to the longitudinal axis 86, so as to avoid shifting or movement of the second seat 40 relative to the first seat 10 during use.

By way of illustrative example, each of the first and second seats 10, 40 can be made from a polymer based material which may be a thermoplastic polymer such as polystyrene, polypropylene, and formed by plastic injection molding. In another example, the seats 10, 40 can be press molded from a wood based composite material including a polymer resin. The examples are non-limiting and it would be understood that the first and second seats 10, 40 can be made from a molded material, such as a polymer or polymer composite material, a wood-based material, a wood composite, or any other suitable material for the fabrication of toilet seats as is common in the art.

In the example shown in FIGS. 3-6, the shape of the seats 10, 40 is generally oval. The example is illustrative, and it would be understood that the shape of the seats 10, 40 could be round, oval, elongated oval, square, rectangular, elongated, or trapezoidal in shape, and that the shapes of seat 10 and seat 40 could be different. For example, the shape of the first seat 10 could be generally round and the shape of the second seat 40 could be oval such that the ratio of the aperture length L2 to width W2 of the second seat 40 could be higher than the ratio of the aperture length L1 to width W1 of the larger first seat 10, to provide additional seating support to a small child using the second seat 40. In the example shown, the aperture length and width L2, W2 of the aperture 46 of the second seat 40 are necessarily smaller, respectively, than the aperture length and width L1, W1 of the aperture 16 of the first seat 10, to provide additional seating support to a small child using the second seat 40, and to provide a relatively larger aperture 16 for an adult using the first seat 10. In the illustrative example shown, the seat length and width SW2, SL2 of the second seat 40 are relatively smaller than the seat length and width SW1, SL1 of the first seat 10. This example is non-limiting, and it would be understood that the SW2 and SW1 can be the same size, and/or the SL2 and SL1 can be the same size. In an illustrative example, the width O1 of the anterior opening of the first seat 10 can be the same as or larger than the width O2 of the anterior opening of the second seat 40.

Figure 3:
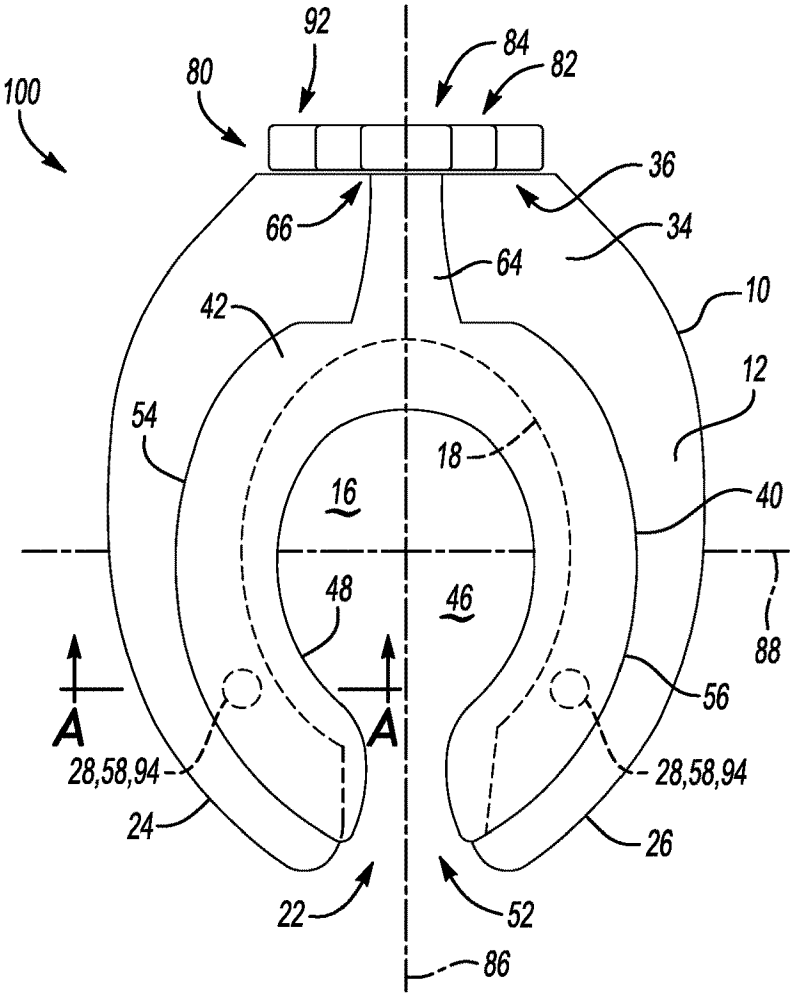
FIG. 3 is a schematic top view of a first example of the toilet seat assembly of FIG. 1 with the first and second seat attached by at least one attaching element.

The seat assembly 100 includes at least one attaching mechanism generally indicated at 94 (see FIG. 1) for selectively attaching the first and second seats 10, 40 to each other by an attaching force F3. When the first and second seats 10, 40 are attached to each other by the attaching mechanism 94, the first and second seats 10, 40 are movable together by an articulating force F1, F2 exerted on either one of the first and second seats 10, 40. That is, when the first and second seats 10, 40 are attached to each other by the attaching mechanism 94, a user can raise or lower both of the seats 10, 40 by contacting only one of the seats 10, 40 and by exerting an articulating force F1, F2 on that one seat, such that contact with the seats 10, 40 and any related unsanitary condition of the seats 10, 40 is minimized, and both seats 10, 40 are easily and efficiently raised or lowered into the position required by the user. Further, because the first and second seats 10, 40 remain attached to each other by the attaching mechanism 94 during movement, the potential for pinching and/or entrapment between the first and second seats 10, 40, and the potential for one of the seats 10, 40 to fall and/or slam is reduced and/or eliminated. The seat assembly 100 can include one or more attaching mechanisms 94. For example, as shown in FIG. 3, the toilet seat assembly 100 includes a pair of attaching mechanisms 94 located at the front portion of each side of the toilet seat assembly. In the example shown in FIG. 4, the toilet seat assembly 100 includes a plurality of attaching mechanisms 94 distributed about the perimeter of the toilet seats 10, 40. The examples shown in the figures are non-limiting, and it would be understood that the toilet seat assembly 100 can include one or more attaching mechanisms 94 arranged so as to provide sufficient attaching force F3 to selectively attach the first and second seats 10, 40 to each other during articulation between a raised and lowered position.

Figure 7:
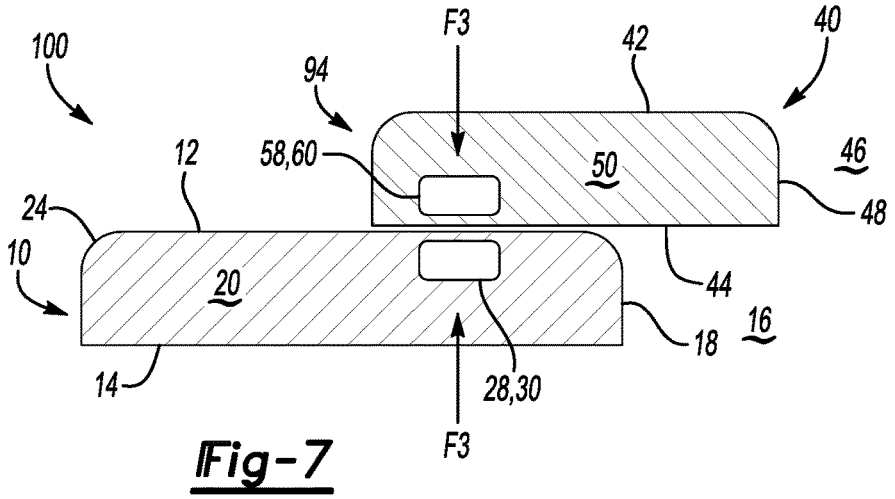
FIG. 7 is a schematic cross-sectional view of a first example of section A-A of FIGS. 3 and 4.

In an example shown in FIGS. 5-7, the attaching mechanism 94 includes a first attaching member 28 and a second attaching member 58. As shown in FIG. 7, the first attaching member 28 is positioned within the core 20 such that the first attaching member 28 is contained within and/or encapsulated by the body of the first seat 10. For example, first and second attaching members 28, 58 can be insert molded or otherwise fastened into the respective cores 20, 50 during forming of the respective first and second seats 10, 40. The first attaching member 28 includes a magnetic element 30. The second attaching member 58 is positioned within the core 50 such that the second attaching member 58 is contained within and/or encapsulated by the body of the second seat 40. The second attaching member 58 includes a magnetic element 60. The first and second attaching members 28, 58 are positioned respectively in the first and second seats 10, 40 such that when the second seat 40 is immediately adjacent the first seat 10, for example, when the first and second seats 10, 40 are both in the lowered position with the second seat 40 resting on and supported by the first seat 10 as shown in FIG. 1, or when both seats 10, 40 are immediately adjacent each other in the raised position as shown in phantom in FIG. 1, the first and second attaching members 28, 58 are aligned with each other as shown in FIGS. 3, 4 and 7. When the first and second seats 10, 40 are immediately adjacent each other, an attractive magnetic attaching force F3 is generated between the magnetic elements 30, 60 of the attaching members 28, 58 to attach the first and second seats 10, 40 to each other. It would be understood that as the base surface 44 of the second seat is brought into close proximity with the upper surface 12 of the first seat 10, the strength of the attractive magnetic attaching force F3 increases to bring the seats 10, 40 together into an attached configuration. Each of the magnetic elements 30, 60 can include a permanent magnet which can be, by way of non-limiting example, of one or more of a ferro-magnetic-type magnet, a ferrite-type magnet, and/or a rare-earth type magnet such as a neodymium-type magnet or neodymium-iron-boron (NIB) magnet. As described previously, when the first and second seats 10, 40 are attached to each other by the attaching mechanism 94, the first and second seats 10, 40 can be articulated together by an articulating force applied to either the first seat 10 or the second seat 40, thus minimizing user contact with the seat assembly 100 when moving the seats 10, 40 between raised and lowered positions. The attached seats 10, 40 can be separated, for example, when articulating the second seat 40 to a raised position to allow the first seat 10 to be used by a seated user, by exerting a separating force on each of the first and second seats 10, 40 to overcome the magnetic attractive attaching force F3 thereby separating the seats. In one example, the magnetic elements 30, 60 are configured such that the separating force required to overcome the magnetic attractive attaching force F3 is of sufficiently large magnitude such that a small child would have difficulty separating the first and second seats 10, 40, to minimize pinching and/or slamming potential.

Figure 8:
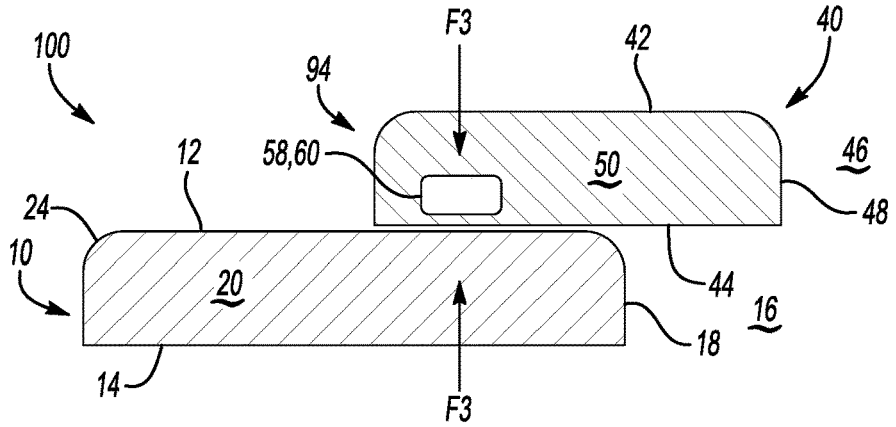
FIG. 8 is a schematic cross-sectional view of a second example of section A-A of FIGS. 3 and 4.

In another example shown in FIG. 8, the attaching mechanism 94 can include an attachment member positioned in one or the first and second seats 10, 40, and the other of the first and second seats 10, 40 including a magnetic material such that when the first and second seats 10, 40 are immediately adjacent each other, an attractive magnetic attaching force F3 is generated between the seats 10, 40 to attach the seats 10, 40 to each other. In the example shown in FIG. 8, the second seat 40 includes an attaching member 58 which includes a magnetic element 60, and the first seat 10 includes a magnetic material. In one example, the core 20 of the first seat 10 can include a magnetic filler material, such as a ferromagnetic or ferrite-based filler material, such that a magnetic attractive attaching force F3 is generated between the attaching member 58 and the core 20. In another example, the seating surface 12 of the first seat 10 can be formed of a material, such as a coating material, which can include a magnet filler material, such as a ferromagnetic or ferrite-based filler material, such that a magnetic attractive attaching force F3 is generated between the attaching member 58 and the seating surface 12 to attach the first and second seats 10, 40 to each other. The example is non-limiting, and it would be understood that the seating assembly 100 could be formed with a magnetic element 30 included in the first seat 10 and the second seat 40 comprising a magnetic material.

Figure 9:
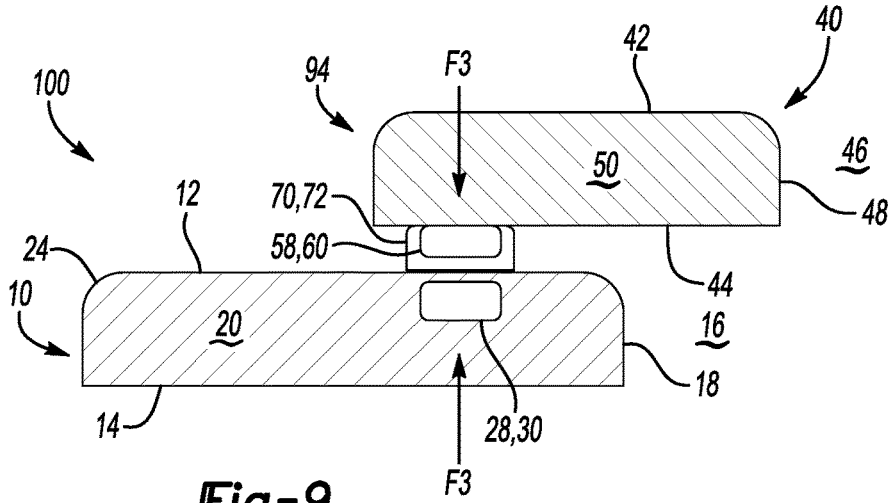
FIG. 9 is a schematic cross-sectional view of a third example of section A-A of FIGS. 3 and 4.

In another example shown in FIG. 9, the attaching mechanism 94 includes first and second attaching members 28, 58, where the first attaching member 28 contained in the first seat 10 and includes a magnetic element 30, as previously described herein. The second seat 40 includes a support member 70 which protrudes from the base surface 44 of the second seat 40. The support member 70 can be fastened to the second seat 40 by any suitable means, including, for example, fastening using an adhesive, a fastener such as a screw or pin, inserting and/or press-fitting the support member 70 into the core 50, etc. In one example, the support member 70 can be integral to the second seat 40, for example, the support member 70 and casing 72 encapsulating the attaching member 58 can be molded concurrently with molding of the second seat 40. The support member 70 includes the second attaching member 58, which in the example shown contains a magnetic element 60. With the first and second seats 10, 40 immediately adjacent each other, the support member 70 is in contact with the seating surface 12 of the first seat, to establish a gap between the base surface 44 of the second seat and the seating surface 12 of the first seat. The gap established by the support member 70 minimizes the contact and transfer of contamination between the base surface 44 of the second seat 40 and the seating surface 12 of the first seat 10. The gap between first seat 10 and the second seat 40 established by the support member 70 can also serve to prevent and/or minimize pinching or entrapment of fingers, skin, clothing, etc. between the first seat 10 and the second seat 40 by a user of the seat assembly 100. As described for FIG. 7, when the first and second seats 10, 40 are immediately adjacent each other, an attractive magnetic attaching force F3 is generated between the magnetic elements 30, 60 of the attaching members 28, 58 to attach the first and second seats 10, 40 to each other. It would be understood that as the base surface 44 of the second seat is brought into close proximity with the upper surface 12 of the first seat 10, the strength of the attractive magnetic attaching force F3 increases to bring the seats 10, 40 together into an attached configuration. The support member 70 can include a casing 72 to encapsulate the magnetic element 60, as shown in FIG. 9. In one example, the casing 72 can be made of a slip-resistant material such that the casing 72 in contact with the seating surface 12 of the first seat 10 prevents slippage and/or lateral movement of the second seat 40 relative to the first seat 10. By way of non-limiting example, the casing 72 can be made of a polymer material such as a thermoplastic material or other suitable slip resistant material such as a natural or synthetic rubber material.

Figure 10:
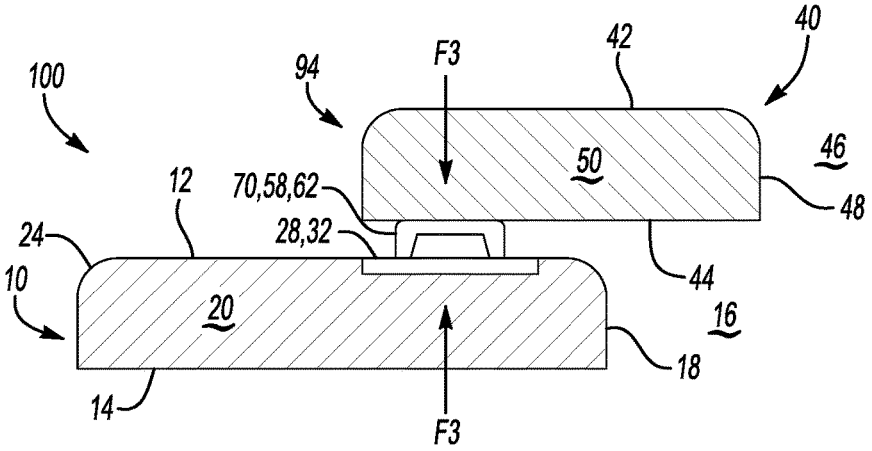
FIG. 10 is a schematic cross-sectional view of a fourth example of section A-A of FIGS. 3 and 4.

In another example shown in FIG. 10, the attaching mechanism includes at least one attaching member 28, 58 including a non-magnetic element 32, 62 for attaching the first and second seats 10, 40. In the illustrative example shown in FIG. 10, the second seat 40 includes an attaching member 58 which includes a non-magnetic element 62 for attaching the first and second seats. The non-magnetic element 62, in one example, is configured to selectively adhere to the seating surface 12 of the first seat 10. By way of example, the non-magnetic element 62 can include one or more of a suction cup, a reusable adhesive, a synthetic gecko adhesive or other gecko-type fastener such as sticky feet, or other reusable dry adhesive such that when the non-magnetic element 62 of the attaching member 58 is placed in contact with the seating surface 12 of the first seat 10, the non-magnetic element 62 generates an attaching force F3 between the first and second seats 10, 40. As described previously, when the first and second seats 10, 40 are attached to each other by the attaching mechanism 94, the first and second seats 10, 40 can be articulated together by an articulating force applied to either the first seat 10 or the second seat 40, thus minimizing user contact with the seat assembly 100 when moving the seats 10, 40 between raised and lowered positions. The attached seats 10, 40 can be separated, for example, when articulating the second seat 40 to a raised position to allow the first seat 10 to be used by a seated user, by exerting a separating force on each of the first and second seats 10, 40 to overcome the attaching force F3 exerted by the non-magnetic element 62, thereby separating the seats. In one example, the attaching mechanism 94 including the non-magnetic element 62 is configured such that the separating force required to overcome the attaching force F3 is of sufficiently large magnitude such that a small child would have difficulty separating the first and second seats 10, 40, to minimize pinching and/or slamming potential.

In the example shown in FIG. 10, the attaching member 58 including a non-magnetic element 62 is configured to protrude from the base surface 44 of the second seat, such that the attaching member 58 functions as a support member 70 to provide a gap between the first and second seats 10, 40, and such that the attaching force F3 generated by the non-magnetic element 62 prevents slippage and/or lateral movement of the second seat 40 relative to the first seat 10. The example described herein is non-limiting, and it would be understood that other configurations of attaching mechanisms 94 including non-magnetic elements 32, 62 could be used to selectively attach the first and second seats 10, 40. For example, as shown in FIG. 10, the first seat 10 can include an attaching member 28 including a non-magnetic element 32, which can be configured to adhere to the attaching member 58 and/or to the base surface 44 of the second seat. In one example, the non-magnetic element 32 can include one or more of a suction cup, a reusable adhesive, a synthetic gecko adhesive or other gecko-type fastener such as sticky feet, or other reusable dry adhesive such that when the non-magnetic element 32 of the attaching member 28 is placed in contact with the base surface 44 of the second seat 40, and/or in contact with the attaching member 58, the non-magnetic element 32 generates an attaching force F3 between the first and second seats 10, 40.

In another example, the attaching mechanism 94 can include attaching members 28, 58 which respectively include non-magnetic elements 32, 62 for mechanically attaching seats 10, 40 to each other. Examples of non-magnetic elements 32, 62 which are reusable mechanical attachments can include snap fit fasteners, clips, and ball and socket fasteners. In such an example, the protruding portion of the fastener, for example, the ball of a ball and socket fastener, would protrude from the base surface 44 of the second seat and the recessed portion, for example, the socket of a ball and socket fastener, would be flush with and/or recessed relative to the seating surface 12 of the first seat, as shown by non-magnetic element 32 in FIG. 10, so as not to affect the comfort of a user sitting on the seating surface 12 of the first seat 10.

Figure 11:
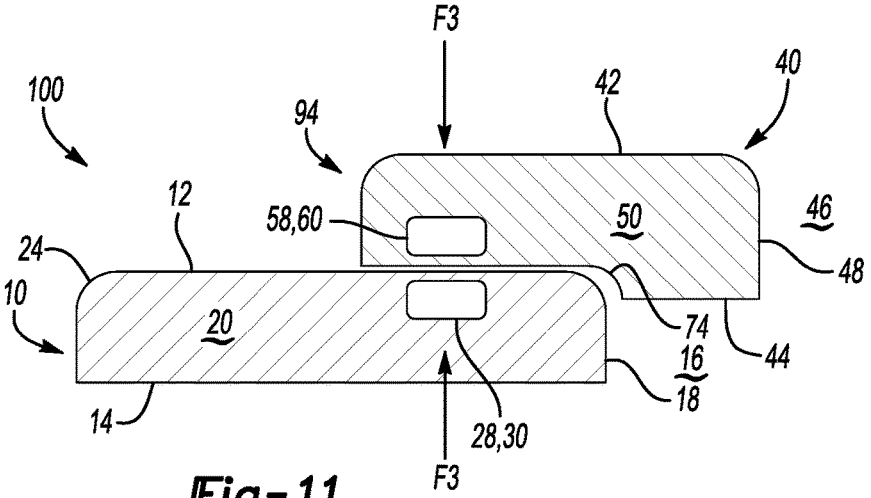
FIG. 11 is a schematic cross-sectional view of a fifth example of section A-A of FIGS. 3 and 4.

In another example shown in FIG. 11, the base surface 44 of the second seat 40 can include a flange or contoured portion 74 extending the periphery 48 of the second seat 40. The flange 74, as shown in FIG. 11, can extend downward into the aperture 16 of the first seat 10, such that the contoured surface of the flange 74 is immediately adjacent to the periphery 18 of the first seat 10, such that, in the event of lateral movement of the second seat 40 relative to the first seat 10, the lateral movement of the second seat 40 relative to the first seat 10 is restricted by contact of and/or interference of the flange 74 with the seating surface 12 of the first seat 10. In the example shown in FIG. 11, the seat assembly 100 is shown including the attaching mechanism described for FIG. 10. It would be understood that the illustration of FIG. 11 is non-limiting, and that a flange 74 can also be included in the example seat assemblies 100 shown in FIGS. 8-10 and 12.

Figure 12:
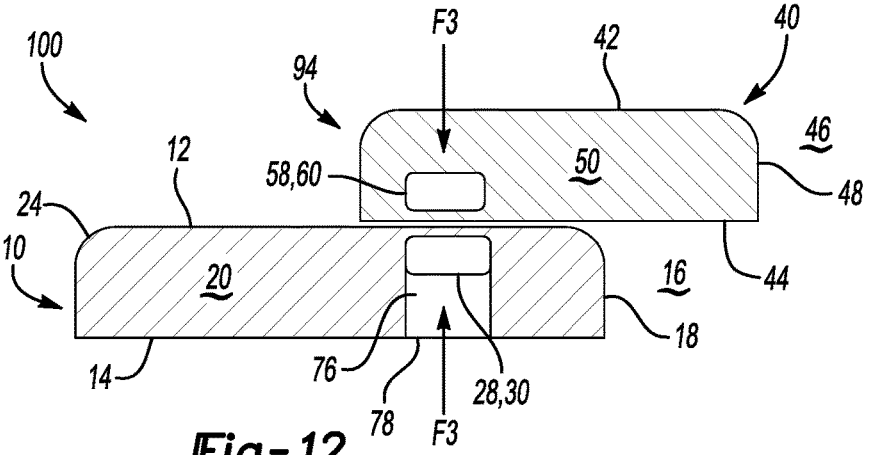
FIG. 12 is a schematic cross-sectional view of a sixth example of section A-A of FIGS. 3 and 4.

FIG. 12 illustrates methods of forming the seats 10, 40 of seat assembly 100. In one method of forming, as shown for the second seat 40 in FIG. 12, the second seat 40 is form by inserting the attaching member 58 into a mold and molding the core 50 of the second seat 40 around the attaching member 58, such that the attaching member 58 is encapsulated by and contained in the second seat 40. In another method of forming, as shown for the first seat 10 in FIG. 12, the first seat 10 can be formed including a recess 76, or alternatively a recess 76 can be formed in the first seat 10, for receiving the attaching member 28. The attaching member 28 can be fastened to the first seat 10 in the recess 76 using any suitable means including adhesives, fasteners, crimping, etc. In one example, a plug 78 can be inserted into the recess 76 to retain the attaching member 28 in the first seat 10, where the plug 78 can be retained in the recess 76 by any suitable means including adhesives, press-fitting, threading, crimping, etc. The examples are not intended to be limiting, and it would be understood that either of the first and second seats 10, 40 could be made by methods described for the other of the first and second seats 10, 40.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A toilet seat assembly configured for installation on a toilet, the toilet seat assembly comprising:

a first toilet seat having a first seat aperture;

a second toilet seat having a second seat aperture;

an attaching mechanism including a first attaching member;

a hinge assembly hingedly connecting the first and second seats to each other;

wherein:

one of the first and second seats includes the first attaching member;

the first and second seats are selectively attached to each other by attachment of the first attaching member to the other of the first and second seat;

the first seat configured to be articulated relative to the hinge assembly;

the second seat configured to be articulated relative to the hinge assembly; and when the first and second seats are attached by the attaching mechanism, the first and second seats can be articulated together by an articulating force exerted on either one of the first and second seats;

a first periphery defining the first aperture;

a second periphery defining the second aperture;

the second seat including a seating surface and a base surface;

a flange extending from the base surface of the second seat; and wherein, with the second seat attached to the first seat, the flange is immediately adjacent the first periphery of the first aperture such that lateral movement of the second seat relative to the first seat is restricted by contact of the flange with the first seat.

2. The toilet seat assembly of claim 1, further comprising:

the attaching mechanism including a second attaching member;

wherein:

the other of the first and second seats including a second attaching member;

the first attaching member includes a first magnetic element;

the second attaching member includes a second magnetic element; and the first and second seats are selectively attached to each other by a magnetic force generated between the first magnetic element and the second magnetic element.

3. The toilet seat assembly of claim 1, wherein the second seat aperture is smaller than the first seat aperture.

4. The toilet seat assembly of claim 1, further comprising a plurality of attaching mechanisms.

5. The toilet seat assembly of claim 1, wherein the first attaching member is contained within the one of the first and second seats.

6. The toilet seat assembly of claim 1, further comprising:

a second attaching member included in the other of the first and second seats; and wherein the first and second seats are selectively attached to each other by attachment of the first attaching member to the second attaching member.

7. The toilet seat assembly of claim 6, wherein the second attaching member is contained within the other of the first and second seats.

8. The toilet seat assembly of claim 6, further comprising:

the first attaching member including a first magnetic element;

the second attaching member including a second magnetic element; and wherein the first and second seats are selectively attached to each other by a magnetic force generated between the first magnetic element and the second magnetic element.

9. The toilet seat assembly of claim 6, further comprising:

a third attaching member included in one of the first and second seats;

a fourth attachment member included in the other of the first and second seats;

wherein the first and second seats are selectively attached to each other by:

attachment of the first attaching member to the second attaching member; and attachment of the third attaching member to the fourth attaching member.

10. The toilet seat assembly of claim 1, wherein: the first attaching member includes a magnetic element; the first seat includes a magnetic material; and the first and second seats are attached to each other by a magnetic force generated between the magnetic element and the magnetic material.

11. The toilet seat assembly of claim 1, wherein the first seat includes a first side portion and a second side portion; and wherein the first and second side portions are separated by an anterior opening therebetween.

12. The toilet seat assembly of claim 1, wherein the second seat includes a first side portion and a second side portion; and wherein the first and second side portions are separated by an anterior opening therebetween.

13. The toilet seat assembly of claim 1, further comprising:

at least one of the first and second seats including a handle extending from the at least one of the first and second seats such that the articulating force is applied via the handle.

14. A toilet seat assembly configured for installation on a toilet, the toilet seat assembly comprising:

a first toilet seat having a first seat aperture;

a second toilet seat having a second seat aperture;

an attaching mechanism including a first attaching member;

a hinge assembly hingedly connecting the first and second seats to each other;

wherein:

one of the first and second seats includes the first attaching member;

the first and second seats are selectively attached to each other by attachment of the first attaching member to the other of the first and second seat;

the first seat configured to be articulated relative to the hinge assembly;

the second seat configured to be articulated relative to the hinge assembly; and when the first and second seats are attached by the attaching mechanism, the first and second seats can be articulated together by an articulating force exerted on either one of the first and second seats;

wherein the hinge assembly includes at least one positioning hinge; and wherein the at least one positioning hinge is operable to:

selectively retain the first seat in a first articulated position; and selectively retain the second seat in a second articulated position.

15. A toilet seat assembly configured for installation on a toilet, the toilet seat assembly comprising:

a first toilet seat having a first seat aperture;

a second toilet seat having a second seat aperture; and a hinge assembly hingedly connecting the first and second seats to each other;

wherein:

the second seat aperture is smaller than the first seat aperture;

the first toilet seat includes a first attaching member;

the second toilet seat includes a second attaching member;

each of the first and second attaching members includes a magnetic element; and the first and second seats are selectively attached to each other by a magnetic force generated between the first magnetic element and the second magnetic element;

wherein the hinge assembly includes at least one check hinge;

wherein, when the seat assembly is installed on the toilet, the at least one check hinge is operable to:

prevent over-articulation of the first seat; and prevent over-articulation of the second seat.

16. A toilet seat assembly configured for installation on a toilet, the toilet seat assembly comprising:

a first toilet seat having a first seat aperture;

a second toilet seat having a second seat aperture; and a hinge assembly hingedly connecting the first and second seats to each other;

wherein:

the second seat aperture is smaller than the first seat aperture;

the first toilet seat includes a first attaching member;

the second toilet seat includes a second attaching member;

each of the first and second attaching members includes a magnetic element; and the first and second seats are selectively attached to each other by a magnetic force generated between the magnetic element of each of the first attaching members and the second attaching members;

wherein, when the first and second seats are selectively attached to each other by the magnetic force, the first and second seats can be articulated together between a lowered position and an articulated position, by an articulating force exerted on either one of the first and second seats.

17. The toilet seat assembly of claim 16, wherein the toilet seat assembly does not include a toilet seat cover.

* * * * *